US007441594B2

(12) United States Patent
Vanderford et al.

(10) Patent No.: US 7,441,594 B2
(45) Date of Patent: Oct. 28, 2008

(54) FULL BORE WELLHEAD LOAD SHOULDER AND SUPPORT RING

(75) Inventors: Delbert E. Vanderford, Cypress, TX (US); Garry Lee Cocker, Houston, TX (US); Bok Soo Yook, Houston, TX (US)

(73) Assignee: Cameron International Corporation, Houston, TX (US)

( * ) Notice: Subject to any disclaimer, the term of this patent is extended or adjusted under 35 U.S.C. 154(b) by 353 days.

(21) Appl. No.: 10/846,413

(22) Filed: May 17, 2004

(65) Prior Publication Data

US 2005/0252653 A1 Nov. 17, 2005

(51) Int. Cl.
*E21B 33/04* (2006.01)

(52) U.S. Cl. ..... 166/75.14; 166/368; 265/123.4

(58) Field of Classification Search ..... 166/75.14, 166/96.1, 208, 217, 368; 285/123.1, 123.3, 285/123.4, 123.13
See application file for complete search history.

(56) References Cited

U.S. PATENT DOCUMENTS 3,087,547 A * 4/1963 Raulins et al. ..... 166/89.1
3,420,308 A 1/1969 Putch
3,548,934 A * 12/1970 Hutchison ..... 166/368
3,736,984 A * 6/1973 Garrett ..... 166/208
4,068,865 A * 1/1978 Shanks, II ..... 285/90
4,295,665 A 10/1981 Pierce
4,353,420 A * 10/1982 Miller ..... 166/382
4,421,164 A * 12/1983 Galle, Jr. ..... 166/118
4,528,738 A * 7/1985 Galle, Jr. ..... 29/416
4,641,708 A * 2/1987 Wightman ..... 166/208
4,886,121 A * 12/1989 Demny et al. ..... 166/382
4,995,464 A * 2/1991 Watkins et al. ..... 166/382
5,026,200 A * 6/1991 van Bilderbeek ..... 403/322.1
5,070,942 A 12/1991 McInnes
5,149,143 A * 9/1992 Howell ..... 285/18
5,209,521 A 5/1993 Osborne
5,307,879 A 5/1994 Kent
5,450,904 A * 9/1995 Galle ..... 166/348

(Continued)

FOREIGN PATENT DOCUMENTS

GB 860914 A 2/1961

(Continued)

OTHER PUBLICATIONS

UK Combined Search and Examination Report for Appln. GB 0509992.4 dated: Jul. 8, 2005 (pp. 4).

*Primary Examiner*—Kenneth Thompson
(74) *Attorney, Agent, or Firm*—Fletcher Yoder

(57) ABSTRACT

A full bore support system for a hanger or other equipment in a wellhead features a support groove in the wellhead that can be integrally made or on an insert. A support ring can have a variety of configuration and features an energizing surface and a limit surface that ultimately share the load. The receiving groove is configured to guide the support ring as it expands to minimize bending and distortion. The support ring is recessed and protected until it is actuated outwardly into a supporting position. A high strength low modulus material is preferred to withstand the radial expansion and the applied loads and environmental conditions. Various shapes for the ring are contemplated including a C-ring and a ring made from segments movable with respect to each other.

10 Claims, 11 Drawing Sheets

U.S. PATENT DOCUMENTS

| | | | | |
|---|---|---|---|---|
| 5,524,710 | A * | 6/1996 | Shinn | 166/348 |
| 5,839,512 | A | 11/1998 | Malone et al. | |
| 5,984,008 | A | 11/1999 | Lang et al. | |
| 6,138,751 | A | 10/2000 | Hart | |
| 6,202,745 | B1 | 3/2001 | Reimert et al. | |
| 6,516,887 | B2 * | 2/2003 | Nguyen et al. | 166/348 |
| 6,598,673 | B1 | 7/2003 | Hosie et al. | |

FOREIGN PATENT DOCUMENTS

| | | | |
|---|---|---|---|
| GB | 2224526 | | 5/1990 |
| GB | 2224526 | A | 5/1990 |
| GB | 2251012 | | 6/1992 |
| GB | 2256664 | A | 12/1992 |
| WO | WO 90/06419 | A | 6/1990 |

* cited by examiner

FULL BORE WELLHEAD LOAD SHOULDER AND SUPPORT RING

FIELD OF THE INVENTION

The field of this invention is load rings and corresponding load shoulders in wellheads for support of hangers and other equipment and more particularly where a full bore is needed in the wellhead.

BACKGROUND OF THE INVENTION

Wellheads are called upon for support of hangers, test plugs and other equipment during drilling and completion phases in a well. Typically the wellhead will have a support shoulder and a reduced bore so that lowering the hanger past a certain point will cause the hanger to become supported. In some designs, multiple shoulders with the same diameter are used to reduce the load applied to each one. A load ring having multiple bearing areas is used in conjunction with these multiple support shoulders to support the hanger off the wellhead.

Some of the problems with such designs are the difficulty in machining to close tolerance a combination of multiple shoulders and a load ring having a similar profile so that when the load is applied, it is divided equally between the multiple load shoulders. Another problem with designs that require reduction in bore size is that it is not possible to advance the hanger past the support point without latching into the support shoulder. In situation where the hanger must be advanced beyond the support shoulder and later raised up and only then supported, the reduced bore designs are not effective. The reduced bore designs are also costly because they require over-sizing the wellhead in order to have the requisite minimum bore diameter in it. Even in designs that use a single load surface in the wellhead, problems arise in design of a load ring that could expand to the required dimensions without distortion while still being strong enough to carry the applied load. In some designs the groove into which the expanding load ring was destined to enter did not provide adequate guidance to deal with bending or twisting that could occur as the diameter was increased. In other designs the load ring on the hanger was left unprotected during run in and left exposed to potential physical damage before it was urged into the supporting position. In other designs voids are added to the load ring that is intended to be sprung into a groove in the wellhead in a manner that can weaken the ability of the ring to resist bending and torsional forces that can occur during its release into the wellhead grove and subsequent loading applied from the hanger weight. Some designs only use sloping contact shoulders that maximize radial load components and promote distortion of the load ring as its diameter grows.

Some examples of prior designs that include one or more of the above stated shortcomings can be seen in U.S. Pat. Nos. 5,839,512; 4,295,665; 5,209,521; 5,984,008; 6,202,745 B1; 6,598,673 B1 and 3,420,308.

The present invention seeks to address these issues with a design that is simple to manufacture and repair and provides full bore access in the wellhead. It features an energizing taper and a limit shoulder that share the load. The receiving groove is shaped to anticipate the potential distortions in the ring as its diameter is increased and bring the ring back to shape. The receiving groove, at its depth is designed to encounter the ring to lend further guidance and support. The load can be shared between the energizing taper and the limit shoulder. The ring can also be made from a high strength low modulus material to enhance load carrying capability while permitting spanning of larger radial distances. Various designs are contemplated including C-rings and segmented rings where the segments are held to each other in a variety of ways. Those skilled in the art will more readily appreciate the various aspects of the invention from a description of the preferred embodiment and the claims, which appear below.

SUMMARY OF THE INVENTION

A full bore support system for a hanger or other equipment in a wellhead features a support groove in the wellhead that can be integrally made or on an insert. A support ring can have a variety of configuration and features an energizing surface and a limit surface that ultimately share the load. The receiving groove is configured to guide the support ring as it expands to minimize bending and distortion. The support ring is recessed and protected until it is actuated outwardly into a supporting position. A high strength low modulus material is preferred to withstand the radial expansion and the applied loads and environmental conditions. Various shapes for the ring are contemplated including a C-ring and a ring made from segments movable with respect to each other.

DETAILED DESCRIPTION OF THE PREFERRED EMBODIMENT

Figure 1:
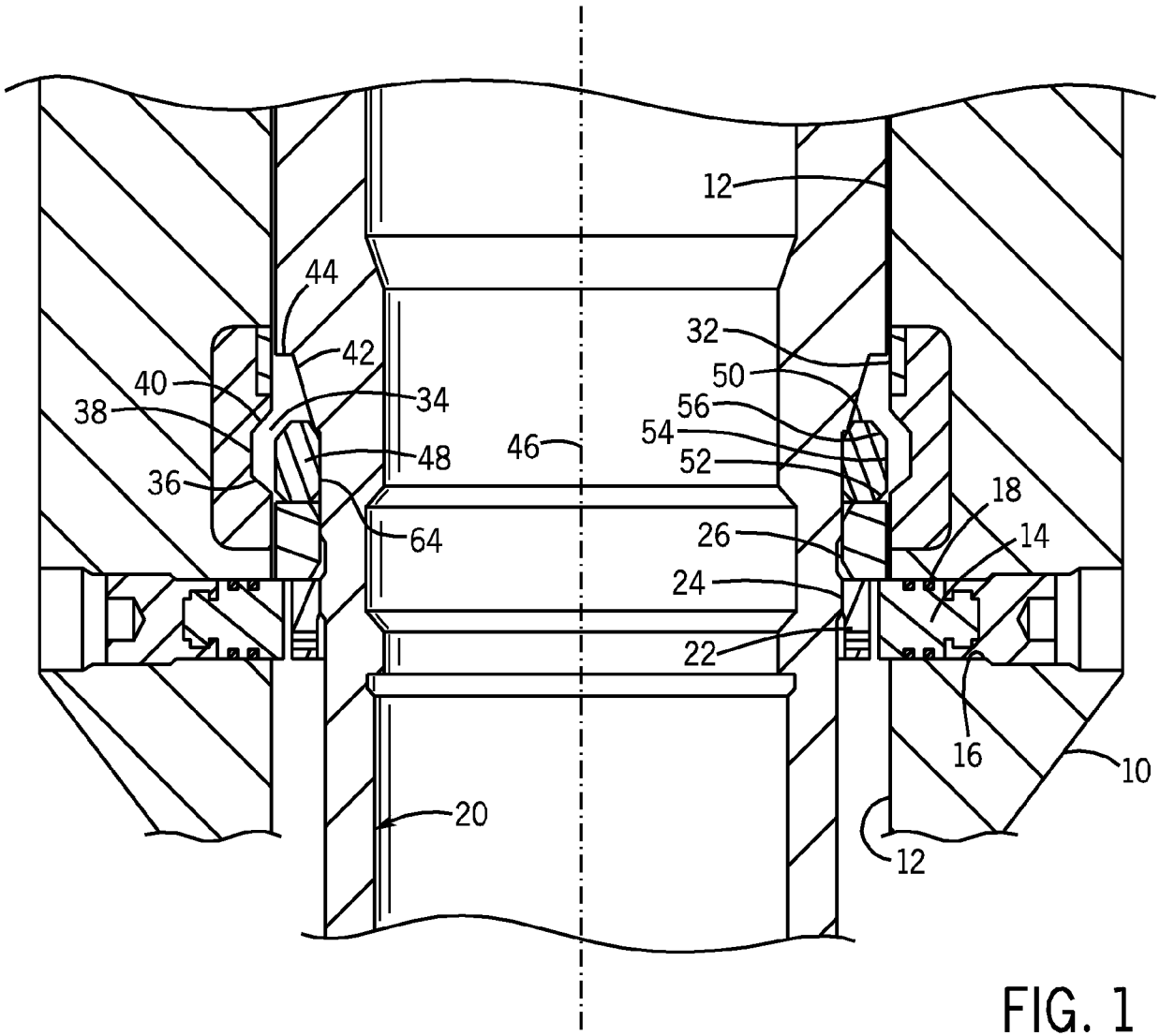
FIG. 1 is a section view of the wellhead with the stop pins extended and the energizing ring about to start pushing the load ring up the energizing taper.
Figure 9:
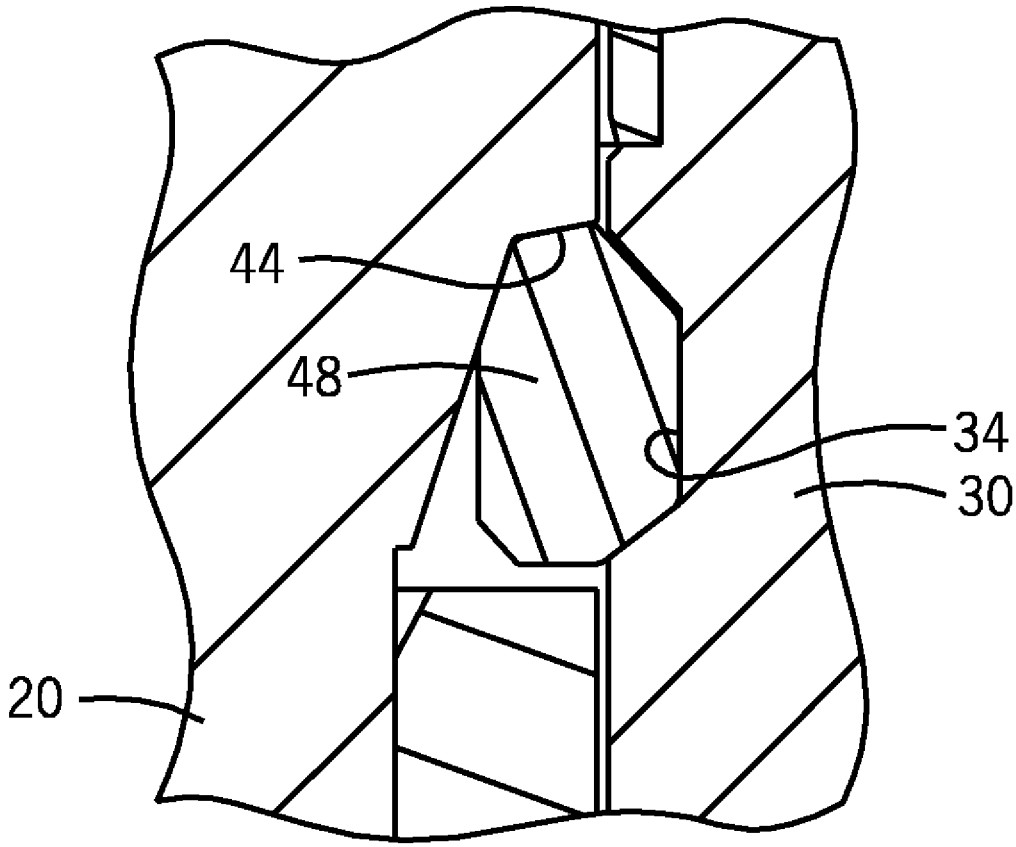
FIG. 9 is a detailed view, in section of the load ring set in its receiving groove in the wellhead.

Referring to FIG. 1, the wellhead 10 has a bore 12 that remains constant in the region shown. One or more stop pins 14 are in respective bores 16 and sealed with seals 18. The hanger or other device to be suspended 20 has a retaining ring 22 attached at thread 24. An energizing ring 26 rests on ring 22 and pins 14 when the hanger 20 is lowered in wellhead 10 to the position shown in FIG. 1. Wellhead 10 also has a recess 28 in which a ring 30 is fitted and secured in recess 28 with a split ring retainer 32. Ring 30 has a groove 34 defined by surfaces 36, 38 and 40. Those skilled in the art will appreciate that groove 34 can be integral to the wellhead 10 as an option. Using the ring 30 to create the groove 34, whose peak coincides with bore 12, allows the ring 30 to be replaced if the groove 34 becomes worn or damaged over time. The hanger 20 features an energizing taper 42 and an adjacent limit shoulder 44 which can be flat, as shown in FIG. 1 or sloping downwardly in a direction toward centerline 46, as shown in FIG. 9. In some situations a slight angle may be desirable to reduce or more uniformly distribute stresses in the load support area. An inherent benefit of this design is to prevent accumulation of debris.

As shown in FIG. 1, the expanding load shoulder 48 has a top surface 50 that will ultimately engage shoulder 44. Surfaces 52, 54 and 56 correspond to surfaces 36, 38 and 40 of groove 34 such that when load shoulder 48 is forced along taper 42 there results a close fit on the respective trio of surfaces as between the groove 34 and the load shoulder 48 as will be described later in more detail.

Figure 2:
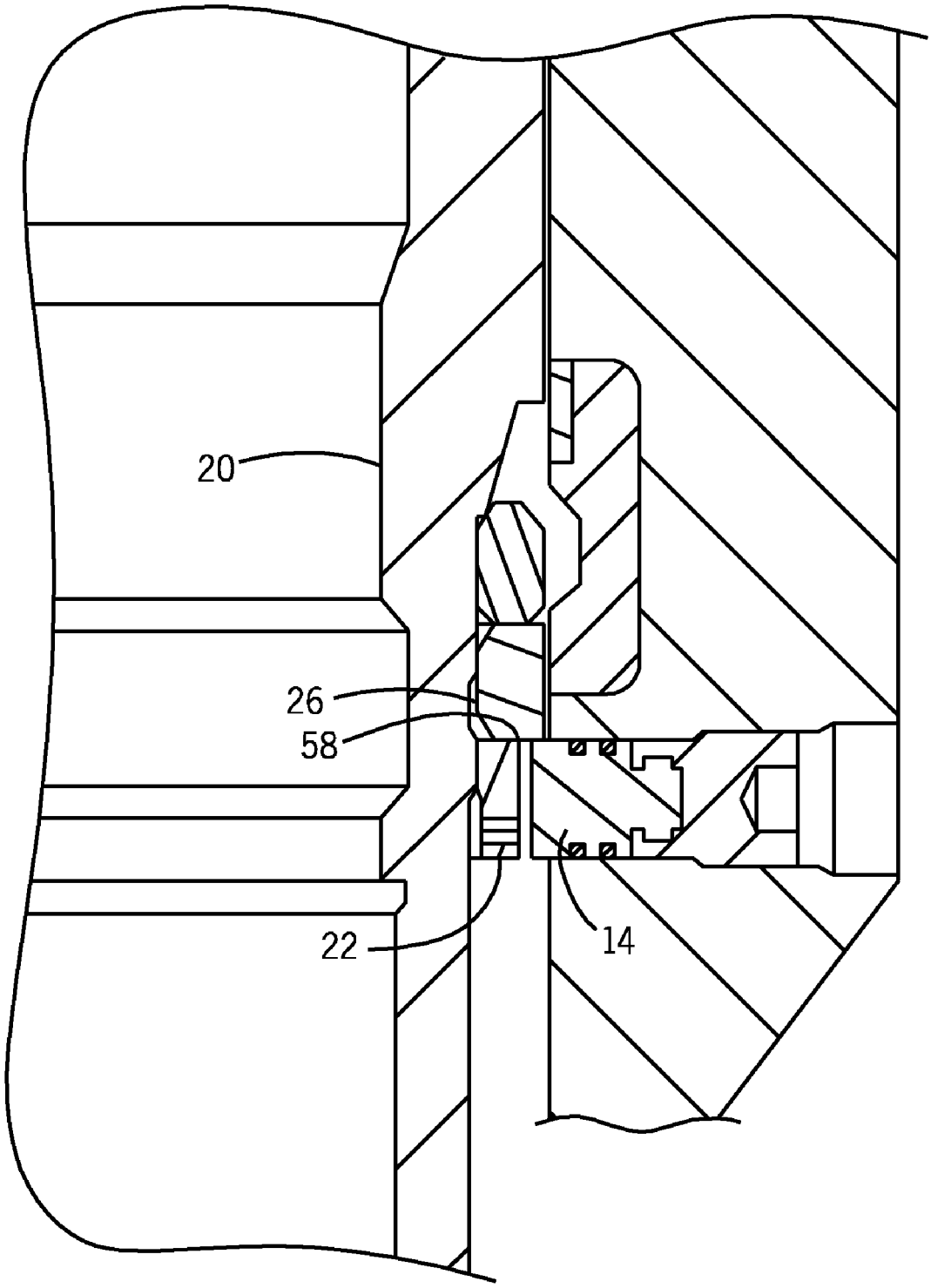
FIG. 2 is similar to FIG. 1 except that the retaining ring is shear pinned to the energizing ring.

FIG. 2 is similar to FIG. 1 with the exception that energizing ring 26 is retained to retaining ring 22 by at least one shear pin 58 which eventually breaks as the hanger 20 is advanced with stop pins 14 extended.

Figure 3:
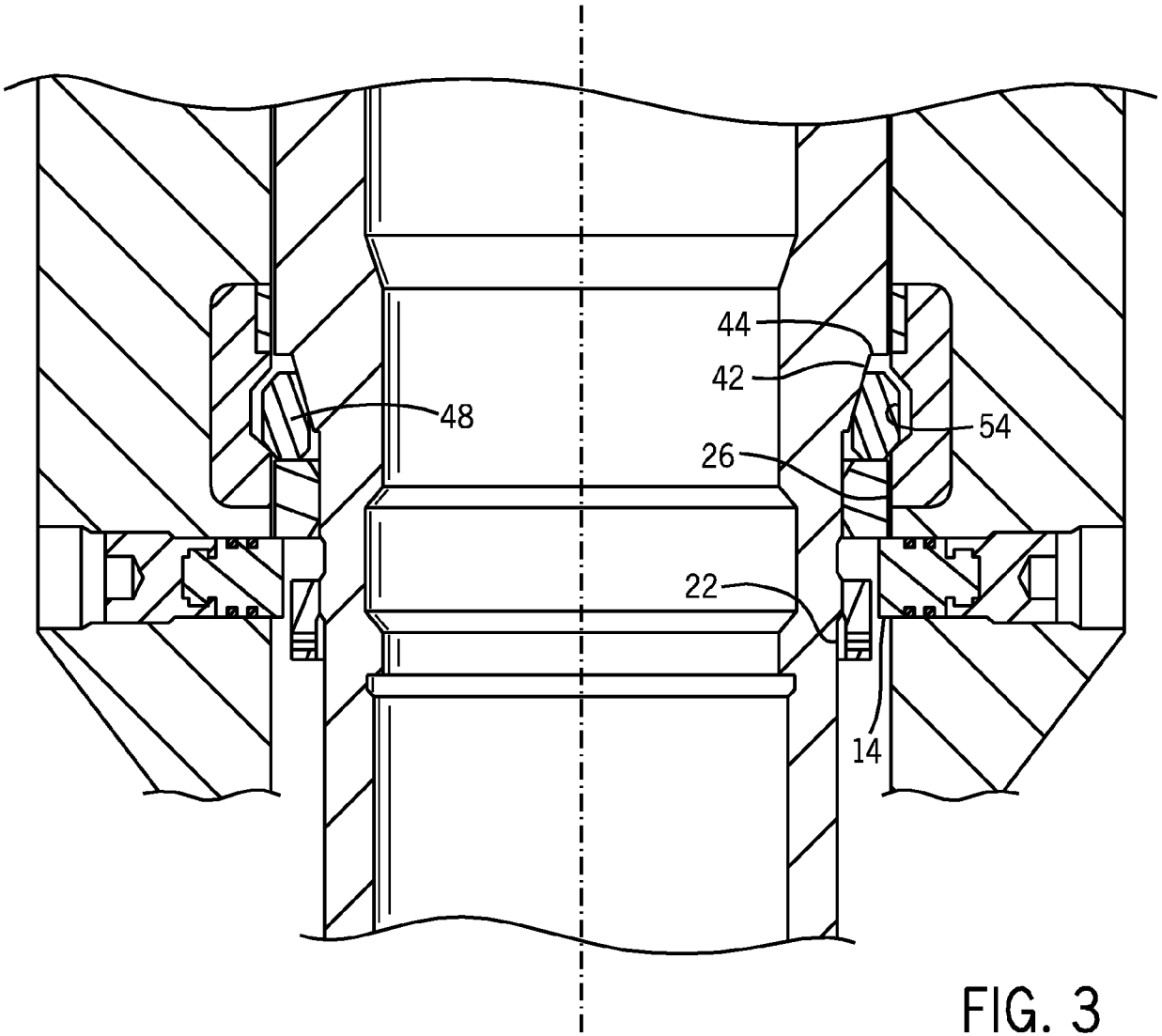
FIG. 3 is the view of FIG. 1 showing some movement of the load ring up the energizing taper.

FIG. 3 shows the continuing sequence of movement. In FIG. 3 the load shoulder 48 has been advanced part way up the taper 42 but it still bears on the energizing ring 26. At this point surface 54 has begun to protrude beyond shoulder 44, which had been previously protecting it from mechanical impacts during earlier operations. At this point, the energizing ring 26 is suspended by the pins 14 and not by ring 22.

Figure 4:
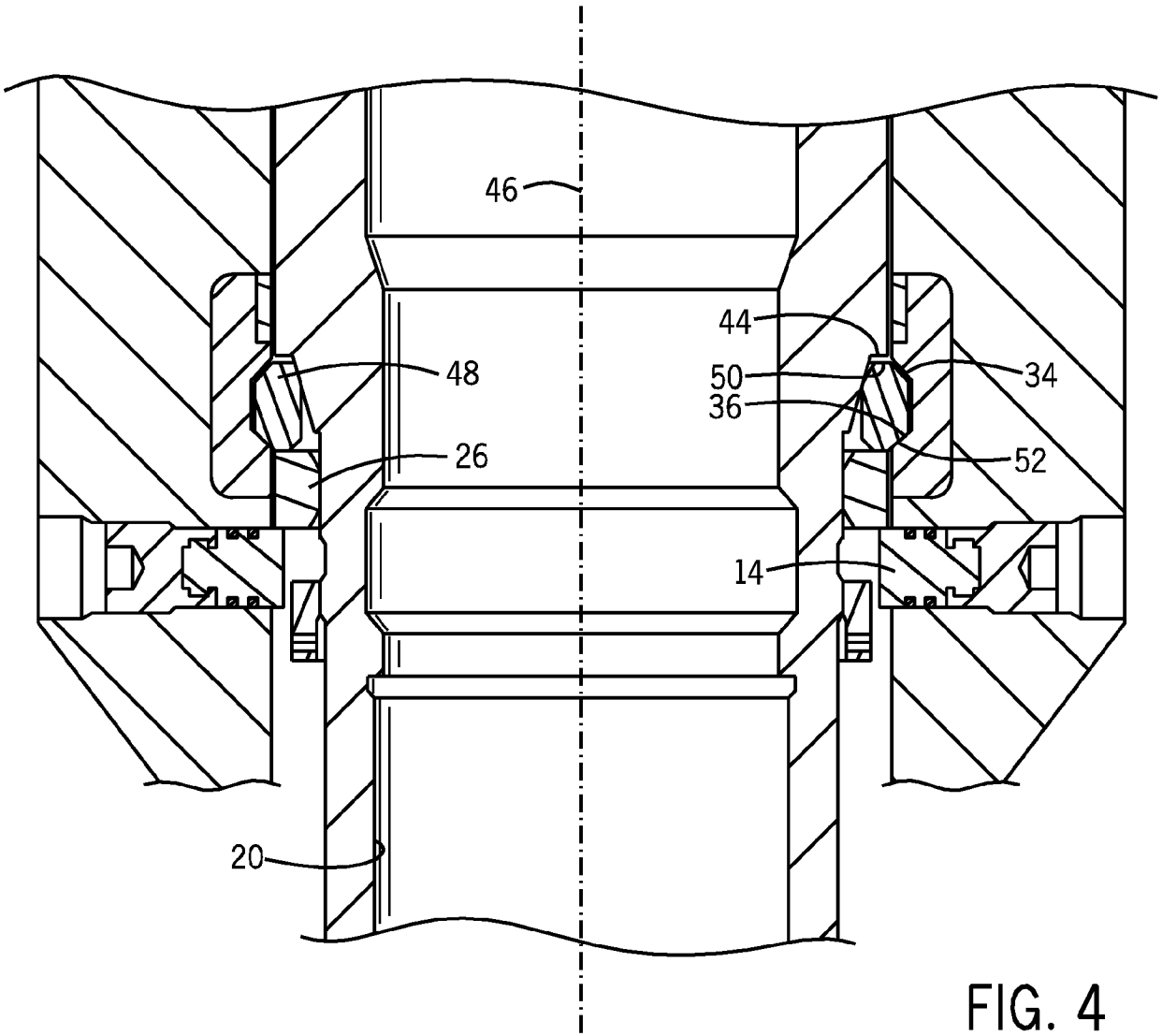
FIG. 4 is the view of FIG. 3 showing the load ring having moved up away from the energizing ring supported by the stop pins to the nearly set position in the recess comprising the load shoulder.

FIG. 4 shows a nearly set position that results from further downward movement of the hanger 20 with pins 14 extended. Surface 50 has yet to be engaged circumferentially by shoulder 44. However, load shoulder 48 has been sufficiently radially expanded so that it has moved up and away from energizing ring 26. This upward movement is caused by surface 52 moving along inclined surface 36. The trio of surfaces on the load shoulder 48 has moved closer to their corresponding surfaces that define the groove 34. Indeed at some points along the circumference there may be guiding contact to help hold the load shoulder ring 48 against bending out of a plane perpendicular to axis 46 or against torsional distortion about its circumferential axis, as will later be described with respect to FIGS. 6 and 7.

Figure 5:
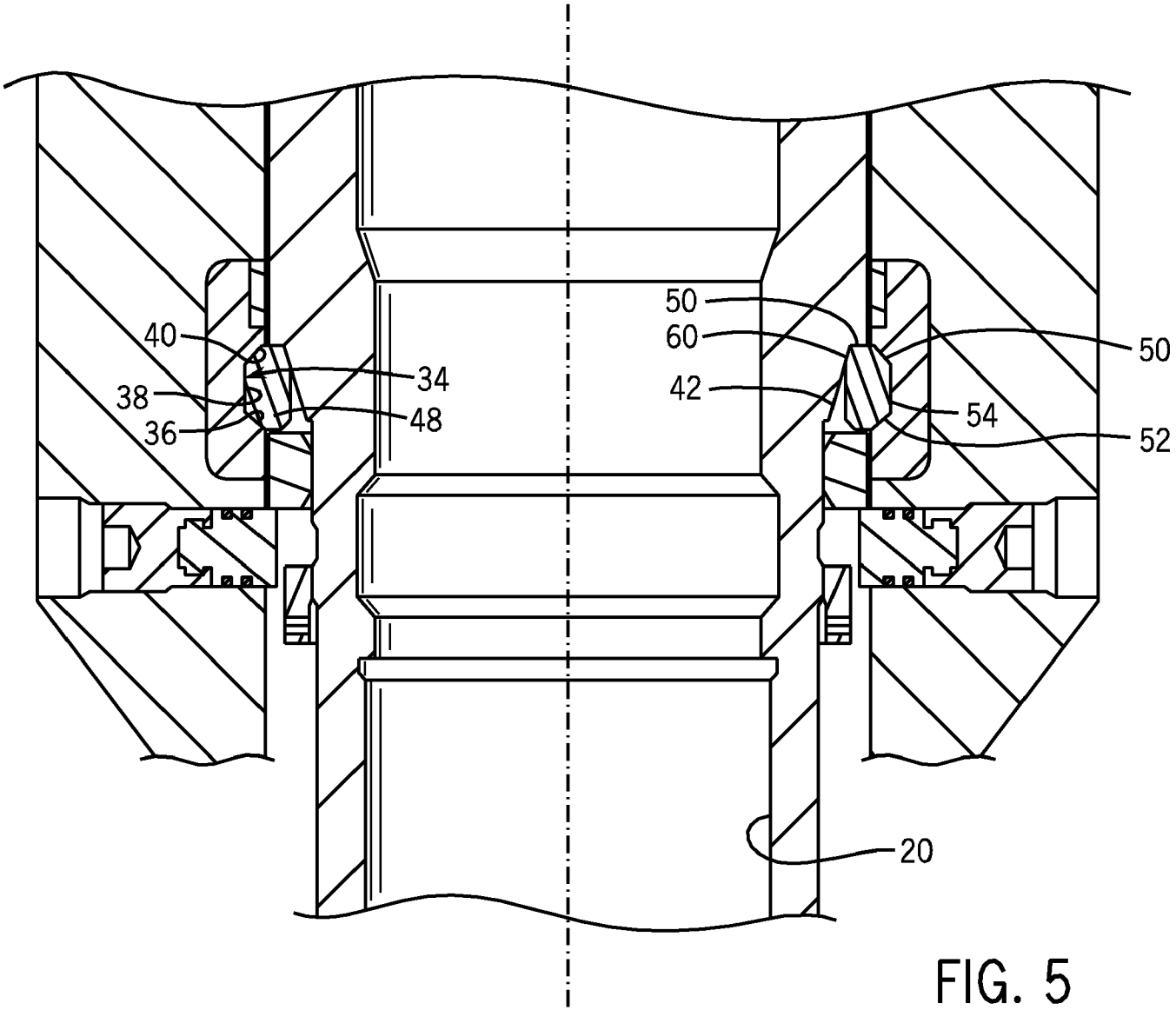
FIG. 5 is the view of FIG. 4 showing the fully set position of the load ring.

FIG. 5 illustrated the fully set position. Note that surface 60 on ring 48 is still engaged by taper 42. The top surface 50 is against shoulder 44. Preferably continuous contact in groove 34 occurs as between the surfaces 52, 54 and 54 and the respective groove surfaces 36, 38 and 40. This close fit prevents bending and torsional deformation of the load shoulder ring 48 despite the radially outward deflection resulting from use of a single groove 34 for support of the hanger 20. Note that the load of the hanger 20 is supported from adjacent surfaces 50 and 60 on the load shoulder ring 48.

Figure 6:
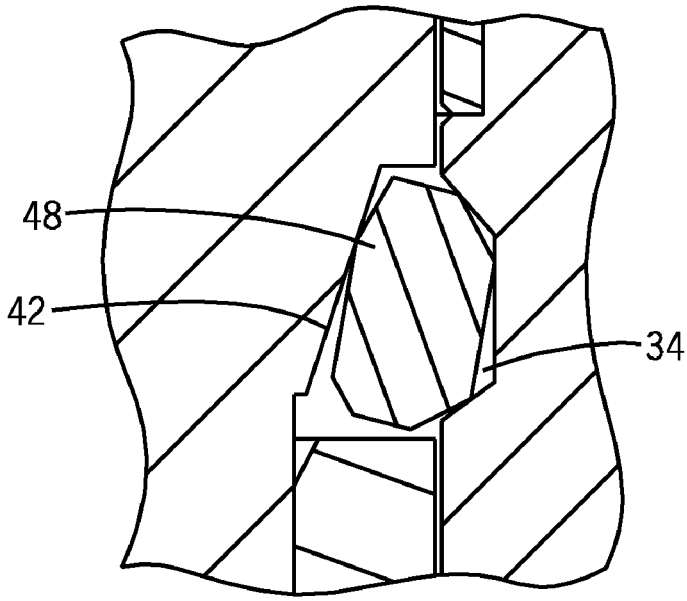
FIG. 6 is a section through the load ring showing how it can bend or twist as its diameter is increased through movement on the energizing taper.

FIG. 6 illustrates how groove 34 engages load shoulder ring 48 as ring 48 is expanded along taper 42. The ring 48 can twist about its own central axis but the configuration of the groove 34 holds and moves it back toward its original plane and resists the torsional forces in part induced by bending during expansion to facilitate the assumption of the final position shown in FIG. 5. Prior designs could fail if they allow the bending and/or twisting of the load ring to become great enough which could prevent the preferred situation of uniform circumferential flush contact and thus create areas of high localized stress that can lead to deformation of ring 48 and to failure to support the hanger 20.

Figure 7:
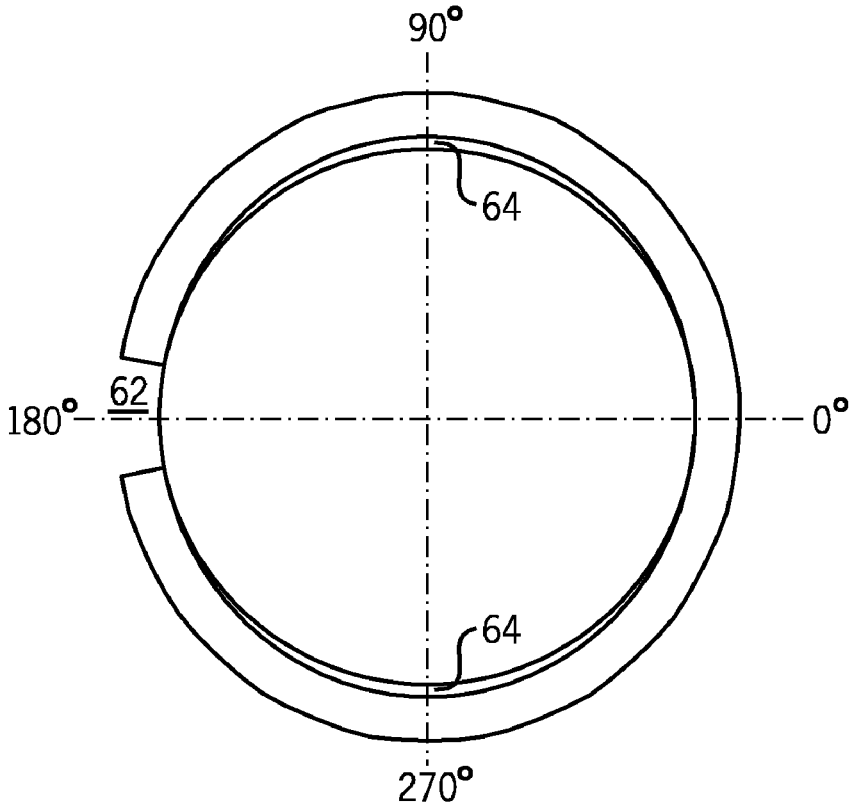
FIG. 7 is a plan view of the load ring shown in section in FIG. 6 and illustrating how the load ring can bend as its diameter is increased.

FIG. 7 illustrates a C-ring shape to load shoulder ring 48 as viewed from above when its diameter is increasing and gap 62 is opening up. For ease of description gap 62 is referred to as being located at 180°. It can be seen that as the gap 62 increases, the most bending occurs at the 0° position. This location also experiences some twisting in torsion as the ring 48 responds to stresses imposed on it from an increase in its diameter. The fact that inside surface 64 becomes visible from the overhead view of FIG. 7 during the radial expansion, illustrates the tendency to bend and/or twist graphically. The close fit in groove 34 particularly the intended full bottom contact at surface 38 in the depth of groove 34 resists these tendencies so as to assure the intended load carrying capacity of ring 48 is achieved at the conclusion of the radial expansion.

Figure 8:
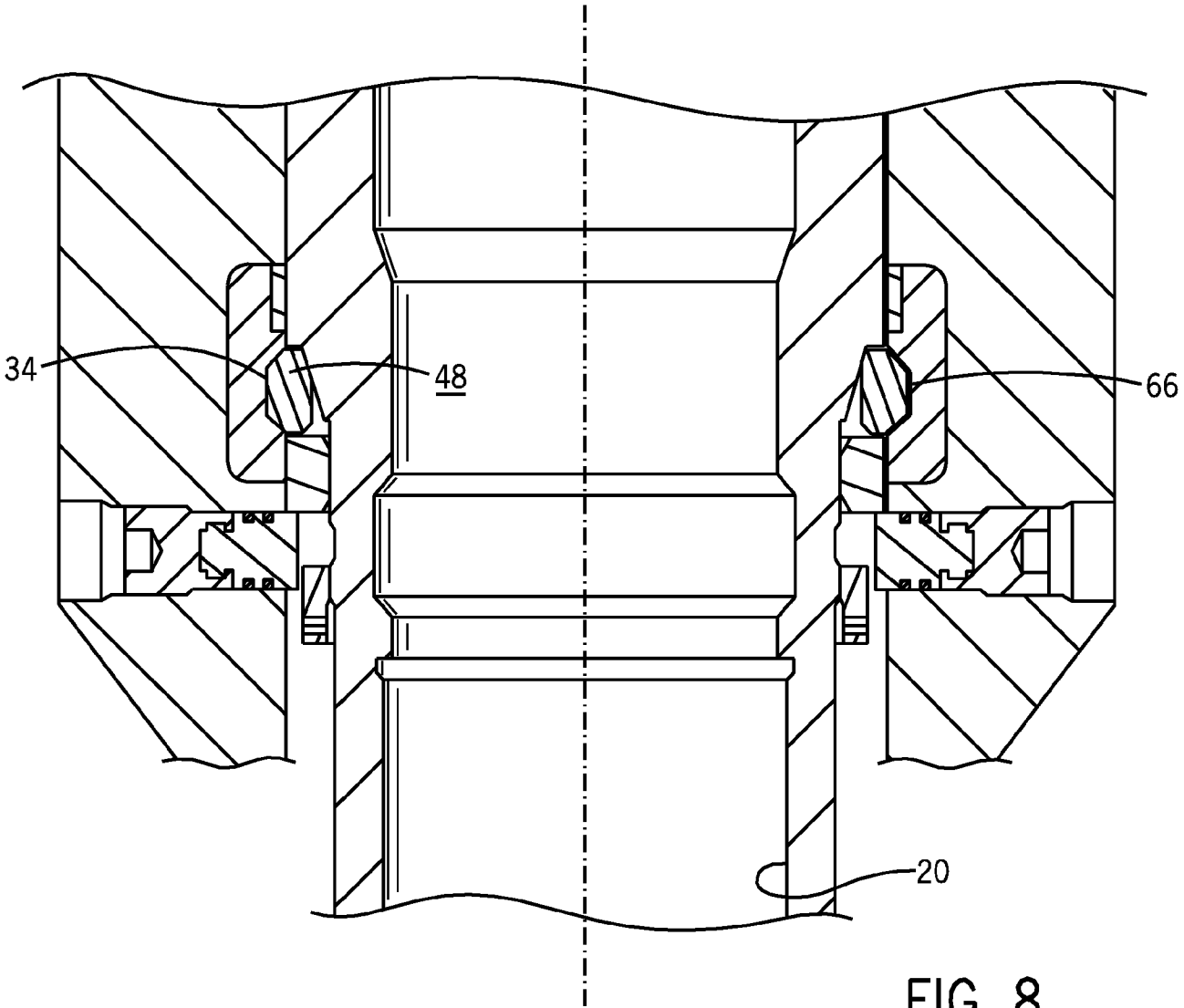
FIG. 8 shows how an offset in position of the hanger is compensated for in the design of the present invention.

A related phenomenon is shown in FIG. 8. Here the hanger 20 has shifted to the left causing the load support ring 48 to bottom in groove 34 on the left side of the drawing while leaving a gap 66 on the right side of the drawing. The gap 66 would normally cause the ring 48 to want to bend or twist out of position but the close fit of groove 34 in conjunction with lateral force exerted on the hanger 20 from the contacting surfaces on the left side of the drawing again contain the ring 48 in the desired plane and resist its tendency to twist responsive to torsional stresses induced from bending during the forced radial expansion as the hanger 20 is set.

FIG. 9 shows an inclined shoulder 44, which is optional. This detailed view also shows the close fit inside groove 34 to ensure a good positioning of ring 48 for adequate support of the hanger 20.

Figure 10A:
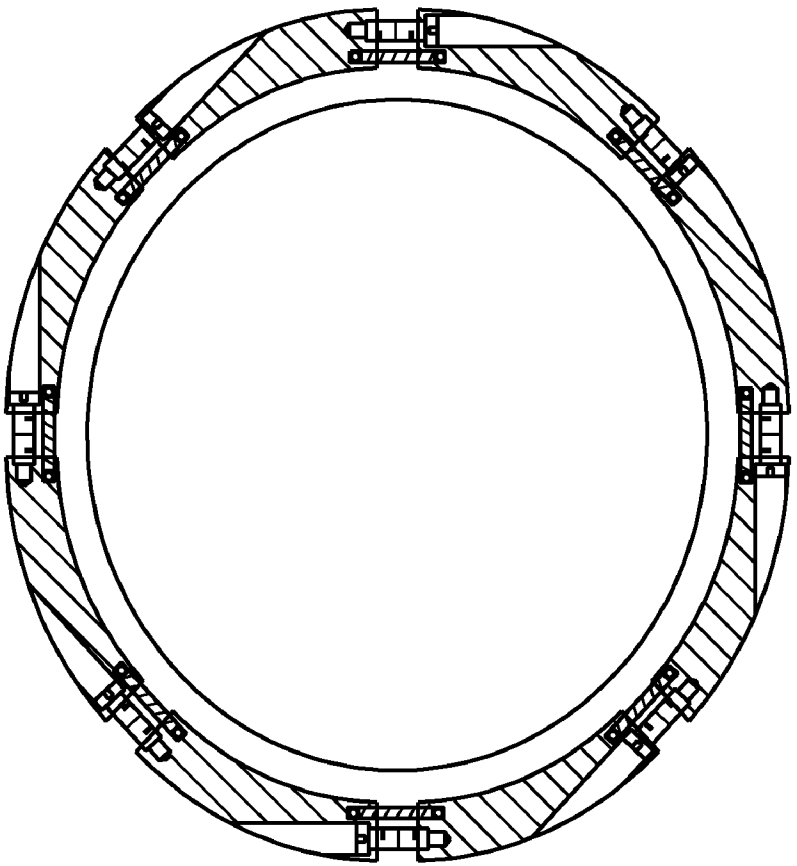
FIGS. 10 and 10*a* show an embodiment of a segmented load ring in the contracted and expanded positions, respectively.
Figure 10:
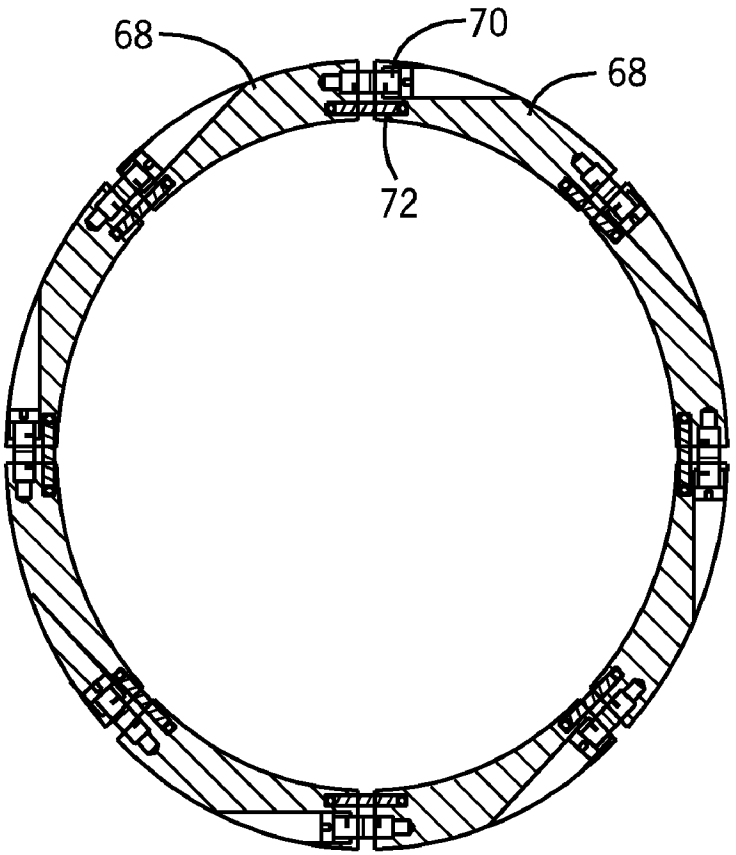

FIGS. 10 and 10*a* show a segmented ring 48 made of segments that are connected for relative movement with respect to each other by bolts 70 which limit the maximum diameter shown in FIG. 10*a*. Between the segments are springs 72 to push the segments 68 apart to assume the position of FIG. 10*a* if the segments 68 are no longer retained to the run in diameter where shoulder 44 can protect them. The FIG. 10 position can be retained by a band (not shown), which can be removed as the radius increases during the hang off procedure.

Figure 11:
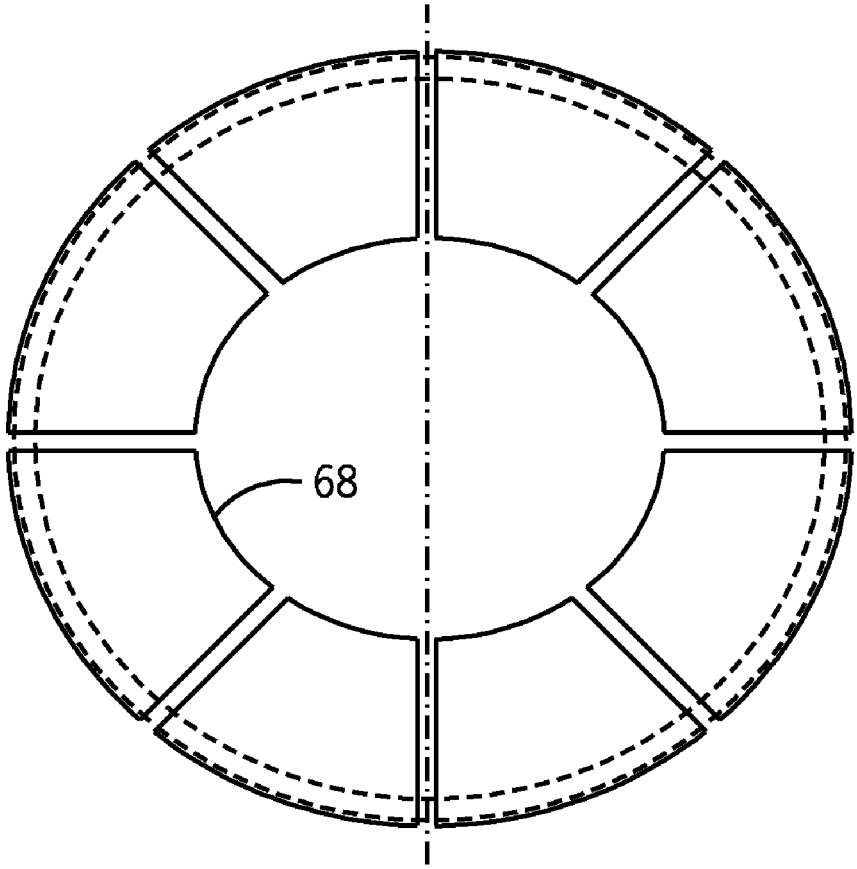
FIGS. 11 and 12 are two views of an alternative design for a segmented load ring showing an outer band holding the segments together.
Figure 12:
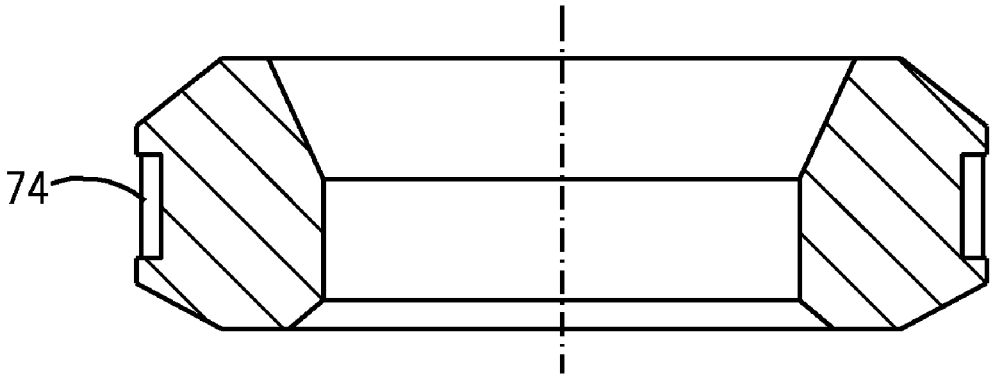
Figure 14:
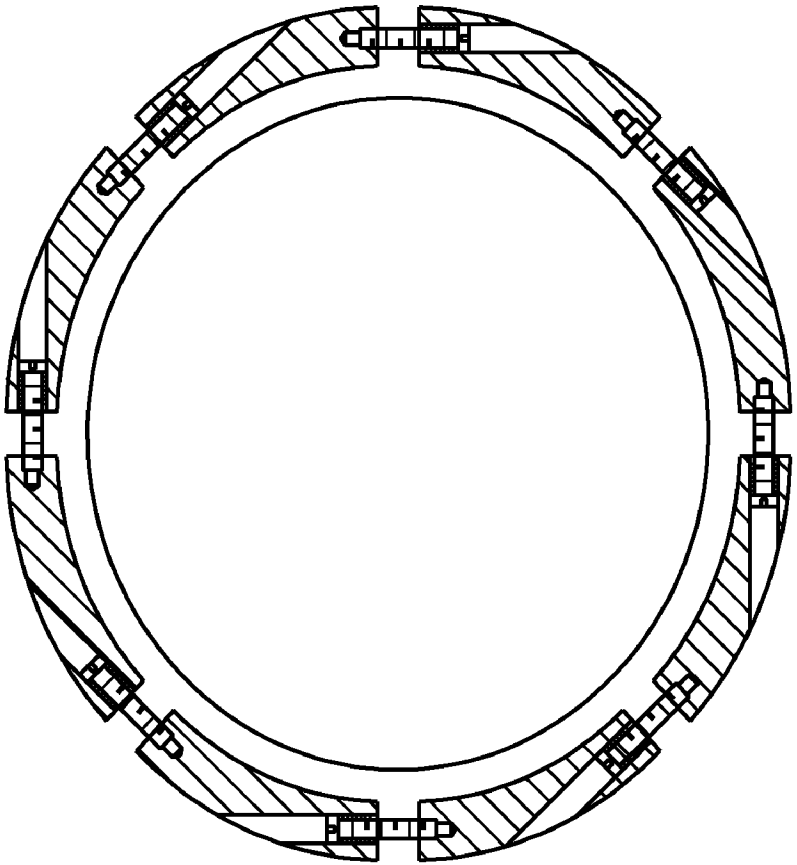
FIGS. 13 and 14 show an alternative embodiment to FIGS. 10 and 10*a* in the retracted and expanded positions, respectively.
Figure 13:
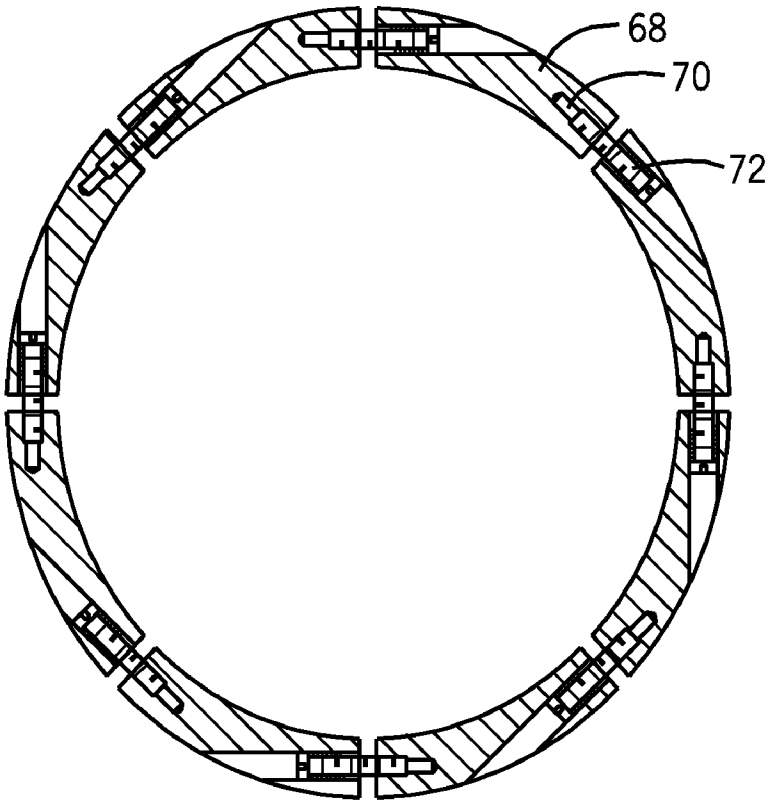

An alternative for a segmented ring 48 is shown in FIGS. 11 and 12. Here the segments 68 are held together for run in by a circumferential band 74, which can be in the shape of a C-ring. The segments stay together as they are driven along taper 42 and then become trapped in groove 34 with the weight of the hanger 20 holding them in groove 34. Yet a slight variation of the design of FIGS. 10 and 10*a* is the design illustrated in FIGS. 13 and 14. Here the springs 72 are mounted around the travel limit bolts 70 but for all intents and purposes, the operation of the load shoulder ring 48 of FIGS. 10 and 10*a* is similar to the version shown in FIGS. 13 and 14.

In the segmented designs, the outer surface 54 on each of the segments is made with a radius to conform closely to the depth of groove 34 defined by surface 38. This results in a wavy appearance of the outer surface of the segmented ring 48 when it is in the run in position. However, after expansion, while the segments may have moved apart their outer surfaces more closely approximate the radius at the depth of the groove 34. This is done to promote better support by the segmented ring 48 of the tubular 20. As previously stated the close proximity of these surfaces on expansion of the segmented ring 48 also helps control bending and twisting as the radius of the segmented ring 48 is increased.

Those skilled in the art will appreciate the various aspects of the present invention. The design allows run in with the ring 48 protected by shoulder 44. The hanger or other device 20 can be lowered past groove 34 without a landing engagement to facilitate other operations before the hanger 20 is ready to be tensioned and supported. The bore 12 needs no reduction in size to facilitate support of the hanger 20. As a result a smaller wellhead 10 can be used with a given bore size to allow further cost savings to the operator. The load ring 48 can take a variety of configurations such as a C-ring or a segmented ring held together in a variety of ways. It should be noted that for the segmented designs shown in FIGS. 10-14 that the outer diameter of the segments is preferably close in dimension to the inside diameter of the groove 34 into which the segments will expand when the diameter is increased due to movement of the segments along taper 42. By doing this, the groove 34 will be better able to retain the relative position of the segments with respect to each other after radial expansion and the weight of the string connected to the hanger 20 will be better supported. In the preferred embodiment, if the ring 48 were perfectly centered in groove 34 there would be a clearance of about 0.005 inches all around. In reality the ring 48 may wind up off center such that the gap between surfaces 54 and 38 could vary between about 0.002 and 0.008 inch. Although this clearance may vary a small amount due to tight tolerances on surfaces 54 and 38, centralization of the ring and subsequent equipment is the desired result. In the present invention the segmented ring design has the segments mounted to the hanger 20 and interacting with each other to support the hanger. This is to be contrasted with prior designs that had individual segments mounted to the wellhead that could be driven in to contact a hanger for support. The ring 48 regardless of its configuration in the present invention is guided by its mating groove 34 to resist bending or twisting under torsional stress that results from driving ring 48 along taper 42. As noted above, such movement can cause a tendency to bend and/or twist which could result in permanent distortion and inadequate support. In the present invention, the mating groove 34 is designed to counteract such forces by relying on close clearances on a multiplicity of surfaces that gets ring 48 into its original shape and orientation as its diameter is being increased. Specifically, contact is envisioned at surface 38 of groove 34 over a substantial portion of its surface area as the expansion is brought to the final diameter. Specifically, it is envisioned that the ring 48 will slide on hanger surface 42, possibly unevenly, and when this situation occurs the preferably tightly controlled surface 38 will assist in keeping ring 48 from twisting, bending or being deformed and help position it properly during the setting process. Ring 48 regardless of configuration is preferably constructed of a high strength low modulus metal preferably titanium. Not only does titanium provide the high strength but it also provides corrosion resistance particularly in wells where hydrogen sulfide is anticipated. Another feature is the load sharing of the entire axial load in the set position between the energizing taper 42 and the adjacent shoulder 44. Shoulder 44 can extend radially or be disposed at an angle, as shown in FIG. 9 to allow debris in well fluids to run off.

The foregoing disclosure and description of the invention are illustrative and explanatory thereof, and various changes in the size, shape and materials, as well as in the details of the illustrated construction, may be made without departing from the invention and the claims below are intended to define the range of the invention.

We claim:

1. A support system for a tubular in a wellhead, comprising:

a tubular body having a support groove surrounding a bore therethrough;

a tubular having an energizing taper; and a load assembly comprising a load member supported on the tubular in a run in position, wherein the load member is configured to pass the support groove without engagement therewith and to selectively engage the support groove upon expansion by the energizing taper;

wherein the tubular body comprises at least one extending member selectively extendable into the bore to engage the load assembly.

2. The support system of claim 1, wherein the bore is not reduced in diameter in a region adjacent the groove.

3. The support system of claim 1, wherein as the load member is moved away from the run in position, the support groove retains the load member against significant bending out of a plane perpendicular to a longitudinal axis of the bore, significant torsional bending about a circumferential axis of the load member, or a combination thereof.

4. The support system of claim 1, wherein:

the support groove defines a surface having a largest diameter; and the load member comprises an outer surface, whereupon when the load member is moved away from the run in position to a load bearing position within the groove, the outer surface of the load member is advanced into sufficiently close proximity with the surface of the support groove so as to inhibit a tendency of the load member to bend out of a plane perpendicular to a longitudinal axis of the bore, to twist about a circumferential axis of the load member, or a combination thereof.

5. The support system of claim 1, wherein the tubular comprises a load surface adjacent the energizing taper and the load surface is disposed at an included angle away from the energizing taper at least as far as a plane perpendicular to a longitudinal axis of the tubular.

6. A support system for a tubular in a wellhead, comprising:

a tubular body having a support groove surrounding a bore therethrough; and a tubular having a load member supported thereon in a run in position that allows the load member to pass the support groove without engagement therewith;

wherein:

the body further comprises at least one extending member selectively extendable into the bore to block axial movement of the load member;

the tubular comprises an energizing taper to expand the load member toward the support groove; and the support groove moves the load member away from the extending member before the load member supports load of the tubular.

7. A support system for a tubular in a wellhead, comprising:

a tubular body having a support groove surrounding a bore therethrough; and a tubular having a load assembly comprising a load member supported thereon in a run in position;

wherein:

the body further comprises at least one extending member selectively extendable into the bore to engage the load assembly;

the tubular comprises an energizing taper to expand the load member toward the support groove; and the support groove moves the load assembly away from the extending member before the load member supports load of the tubular.

8. The support system of claim 7, wherein the support groove is formed on an insert removably mounted to the body.

9. A support system for a tubular in a wellhead, comprising:

a tubular body having a support groove surrounding a bore therethrough; and a tubular having a load assembly comprising a load member supported thereon in a run in position;

wherein:

the body further comprises at least one extending member selectively extendable into the bore to engage the load assembly;

the tubular comprises an energizing taper to expand the load member toward the support groove; and the tubular comprises a load surface adjacent the energizing taper and the load surface is disposed at an included angle away from the energizing taper at least as far as a plane perpendicular to a longitudinal axis of the tubular.

10. A support system for a tubular in a wellhead, comprising:

a tubular body having a support groove surrounding a bore therethrough; and a tubular comprising:

a load member supported on the tubular in a run in position, wherein the load member is configured to pass the support groove without engagement therewith;

an energizing ring configured to automatically move the load member in a direction generally along a longitudinal axis of the tubular upon engagement of the tubular with the tubular body at a load support region; and an energizing taper configured to expand the load member toward the support groove, wherein the energizing taper, the load member, and the support groove are configured to prevent significant bending of the load member as the load member is moved away from the run in position;

wherein the tubular body comprises an extending member selectively extendable into the bore to engage the energizing ring.

* * * * *